US006225586B1

(12) United States Patent
Watanabe et al.

(10) Patent No.: US 6,225,586 B1
(45) Date of Patent: May 1, 2001

(54) THIN KEYBOARD APPARATUS

(75) Inventors: Kazutoshi Watanabe; Kazuhiro Yokoyama; Tsuyoshi Narusawa, all of Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/285,123

(22) Filed: Apr. 1, 1999

(30) Foreign Application Priority Data

Apr. 3, 1998 (JP) ..... 10-092004

(51) Int. Cl.[7] ..... H01H 13/70
(52) U.S. Cl. ..... 200/344
(58) Field of Search ..... 248/918, 346.03, 248/346.04, 678, 680, 681, 500, 503.1, 506; 200/344

(56) References Cited

U.S. PATENT DOCUMENTS 5,504,283 4/1996 Kako et al. ..... 200/344 X
5,512,719 * 4/1996 Okada et al. ..... 200/344
5,758,763 * 6/1998 Sanda et al. ..... 200/344
6,040,541 * 3/2000 Li ..... 200/344
6,072,133 * 6/2000 Takagi et al. ..... 200/344

* cited by examiner

*Primary Examiner*—Ramon O. Ramirez
(74) *Attorney, Agent, or Firm*—Brinks Hofer Gilson & Lione

(57) ABSTRACT

A keyboard apparatus is able to be made thinner without sacrificing ease of operation or feel. The keyboard apparatus is less expensive and permits easier assembly. Through holes are formed in a metal plate at the locations where retaining members are to be installed, then the resinous retaining members are inserted in the through holes to be mounted on the metal plate. For this purpose, the retaining members are formed by a molding method referred to as an outsert molding method. Supporting members are shaped so that they may be snapped in the retaining members. The retaining members are combined with a membrane switch, the supporting members, a key top, and an elastic member.

8 Claims, 6 Drawing Sheets

THIN KEYBOARD APPARATUS

BACKGROUND OF THE INVENTION

1. Field of the Invention

The present invention relates to a keyboard apparatus used as an apparatus with which to enter characters, etc. and, more particularly, to a thin keyboard apparatus suited for use with a notebook-size computer.

2. Description of the Related Art

FIG. 6 is a sectional view showing a key of a conventional keyboard apparatus 20 as observed sideways. The keyboard 20 is constituted primarily by a key top 1, supporting members 2 and 3, a housing member 31, a membrane switch 4, a metal plate 5, and an elastic member 6.

The key top 1 is provided with a total of four retaining portions 1*a*, 1*a*, 1*b*, and 1*b* which are located at the four corners of the rear surface of the key top 1 to support the supporting members 2 and 3.

The supporting members 2 and 3, which support the key top 1, are installed so that they intersect with each other, and attached by a shaft 8 provided at the center of side faces thereof so that they may circularly move. The supporting member 3 disposed on the inner side has a round through hole 9 formed at the center thereof as shown in FIG. 5. The supporting member 2 disposed on the outer side is shaped like "C" as shown in FIG. 5. The distal ends of the supporting members 2 and 3, respectively, have columnar protuberances 2*a*, 2*a*, 3*a*, and 3*a* projecting outward. The protuberances 2*a* are disposed and inserted in the retaining portions 1*b* so that it may slide back and forth, while the protuberances 3*a* are fitted in the retaining portions 1*a* and rotatably supported therein.

The columnar protuberance 2*b* formed on the proximal end of the supporting member 2 is rotatably attached to a retaining portion 32 of the housing member 31, while the columnar protuberance 3*b* formed on the proximal end of the supporting member 3 is slidably disposed in a recess 33. In the supporting member 3, a shaft (not shown) provided between legs 3*c* and 3*c* is locked by a retaining member protruding from the housing member 31 so as to prevent the supporting member 3 from coming off the housing member 31.

The bottom surface of the housing member 31 is provided with the membrane switch 4 sandwiched between the housing member 31 and the metal plate 5.

The membrane switch 4 is formed of three layers of film sheets (not shown), two layers, namely, the top and bottom layers, of which being provided with printed electrode patterns formed on the opposing inner surfaces thereof. A film type spacer is inserted between the two sheets of the membrane switch 4, and the spacer has holes beneath the respective key tops 1 so that the top and bottom electrodes conduct when the key tops are depressed. The membrane switch 4 is further provided with a plurality of apertures running through the three layers to fasten the housing member 31 and the metal plate 5.

The metal plate 5 formed of a metal constituent such as an aluminum constituent is provided below the bottom surface of the membrane switch 4.

The metal plate 5 is provided with a plurality of apertures in which a plurality of protuberances of the housing member 31 are inserted, the protuberances being formed at the same positions as the apertures. The protuberances of the housing member 31 that jut out from the underside of the metal plate 5 are partially melted to fasten the housing member 31 and the metal plate 5.

The elastic member 6 is disposed at the center of the keyboard apparatus 20. The elastic member 6 passes through the round through hole 9 formed in the housing member 31 and rested on the top surface of the membrane switch 4 without being bonded. The diameter of the through hole formed in the housing member 31 is smaller than the diameter of the bottom end of the elastic member 6, so that the elastic member 6 does not come off the housing member 31 even if it is not secured by bonding.

The elastic member 6 is formed of a constituent providing an urging force so that it is always urged upward.

The conventional keyboard apparatus 20, however, is too thick to satisfy the recent demand for achieving further thinner notebook-size computers.

Normally, in a keyboard apparatus used with a notebook-size computer, a thickness X of a key top has been set to 3 mm at the minimum and a travel distance Y of the key top 1 has been set to 3 mm at the minimum, and making the keyboard apparatus further smaller has been restrained in consideration of the feel and ease of use. Hence, a study has been conducted to determine if any of the members from the housing member 31 and below can be omitted because it was impossible to further decrease the thickness X and the travel distance Y.

As a study result, a method has been proposed in which the retaining portions that support the supporting members 2 and 3 are directly supported by the metal plate 5, thus eliminating the housing member 31. This, however, has been posing a problem of a higher machining cost because directly forming the retaining members on the metal plate 5 requires that the metal plate 5 be cut and raised to form retaining portions 41, 41, 42, and 42 as shown in FIG. 7.

In addition, to install the supporting members 2 and 3, protuberances 3*b* and 3*b* of the supporting member 3 are first hooked to the retaining portions 42 and 42, then the protuberances 2*b* and 2*b* of the supporting member 2 are inserted in the retaining portions 41 and 41 through openings 41*a* and 41*a*. At this time, the protuberances 2*b* and 2*b* must be fitted in with a strong force because the retaining portions 41 and 41 are shaped like arches. This has been presenting a problem in that the assembly takes more time and is more difficult than in the example of the conventional art shown in FIG. 6.

SUMMARY OF THE INVENTION

Accordingly, it is an object of the present invention to provide a keyboard apparatus that permits a thinner design and is inexpensive and easy to assemble.

To this end, according to the present invention, there is provided a keyboard apparatus provided with: a key top, a supporting member which supports the underside of the key top so that the key top may move up and down, a receiving member which supports the supporting member at a proximal end of the supporting member, an elastic member which urges the key top upward at all times, and a membrane switch provided on the underside of the supporting member; wherein the receiving member is directly secured to a base supporting the membrane switch.

Directly securing the receiving member that supports the supporting member to the base as mentioned above obviates the need of providing the housing member, which exists in the example of the conventional art. This makes it possible to make the keyboard apparatus thinner by eliminating the thickness of the housing member. Moreover, since there is no need to directly cut and raise the metal plate, the apparatus can be manufactured at lower cost.

The base is composed of a metal plate, and the receiving member can be formed by using a resin attached to the metal plate by outsert molding.

In this case, the receiving member can be formed as follows: a through hole is formed in the base beforehand at the location where the receiving member or the retaining member is to be formed, then a resin is poured in through the through hole by clamping the metal plate at its both faces by a metal mold.

The foregoing molding method, which is normally referred to as the outsert method, allows the receiving member or the retaining member to be positively and securely fixed to the base.

Preferably, a recess is formed in the back surface of the base to which the receiving member has been secured so that a part of the receiving member is positioned in the recess so as to prevent it from protruding from the back surface of the base.

Thus, the back surface of the base no longer has the protuberances of the receiving member or the retaining member, making it possible to form the keyboard apparatus thinner than the one without the recess in the back surface of the base.

Preferably, the receiving member is constituted by a retaining member having an opening in the top surface thereof, and a retaining member having an opening in a side surface thereof. Further preferably, either of the supporting members is rotatably fitted to the former retaining member, while the other supporting member is slidably inserted in the latter retaining member, and both supporting members intersect with each other and are joined with shafts at the intersecting points so that they may circularly move.

With this arrangement, the supporting members can be installed easily and quickly without applying undue stress to the supporting members. More specifically, to install the supporting members, one shaft formed on the supporting member is first anchored to the retaining member which has, for example, an approximately C-shaped opening in a side surface thereof, then the other shaft formed on the supporting member is pushed from above into the retaining member which has, for example, an approximately U-shaped opening in the top surface thereof.

In the case mentioned above, the recess in the metal plate may be formed by applying pressure at the same time when the apertures are formed in the metal plate, or by other extensively used press molding methods.

More preferably, either of the supporting members is snapped in the retaining member that has the opening in its top surface. In this case, the retaining member is formed in such a shape that allows itself rotatably fitted in either of the supporting members and prevents itself from easily disengaging from the supporting member.

The present invention is not limited to the case wherein the receiving members or the retaining members are fixed to the metal plate serving as the base by the outsert molding method. Alternatively, the receiving members or the retaining members respectively provided with the openings may be separately formed using a resin, then fixed to the base by press-fitting, melt-caulking, or screwing.

Mounting the keyboard apparatus described above on a notebook-size computer enables the computer enclosure to be made thinner, thus permitting improved portability of the notebook-size computer. Moreover, the keyboard apparatus can be fabricated at lower cost, contributing to reduction in cost of the computer main body. In addition, the ease of operation and the feel of the keyboard will not be sacrificed because the thickness and the travel distance of the key tops remain unchanged.

DESCRIPTION OF THE PREFERRED EMBODIMENT

With reference to the accompanying drawings, a keyboard apparatus in accordance with the present invention and a computer incorporating the keyboard apparatus will be described.

Figure 1:
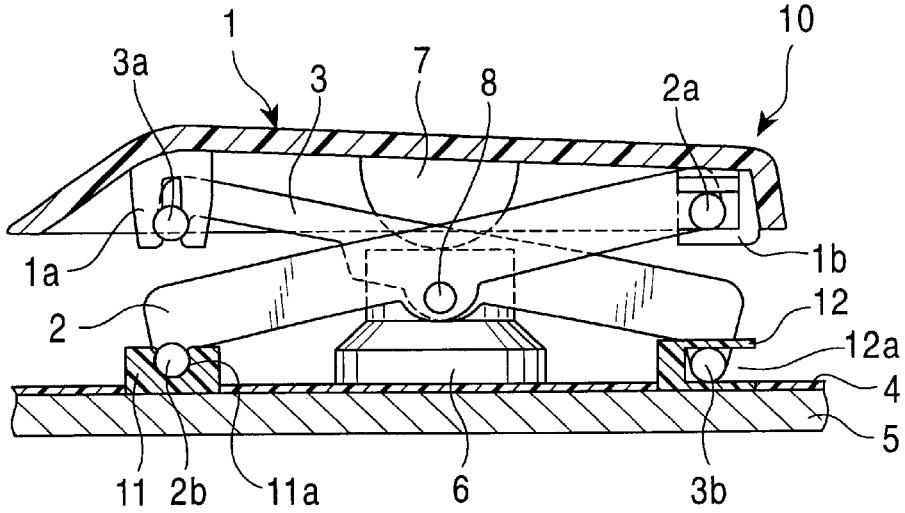
FIG. 1 is a sectional view showing a side surface of a keyboard apparatus in accordance with the present invention.

FIG. 1 is a sectional view of a side surface of a keyboard apparatus in accordance with the present invention. A keyboard apparatus 10 has retaining members 11 and 12 serving as receiving members that are formed on the top of a metal plate 5. The keyboard apparatus 10 further includes key tops 1, supporting members 2 and 3, an elastic member 6, and a membrane switch 4.

Figure 3:
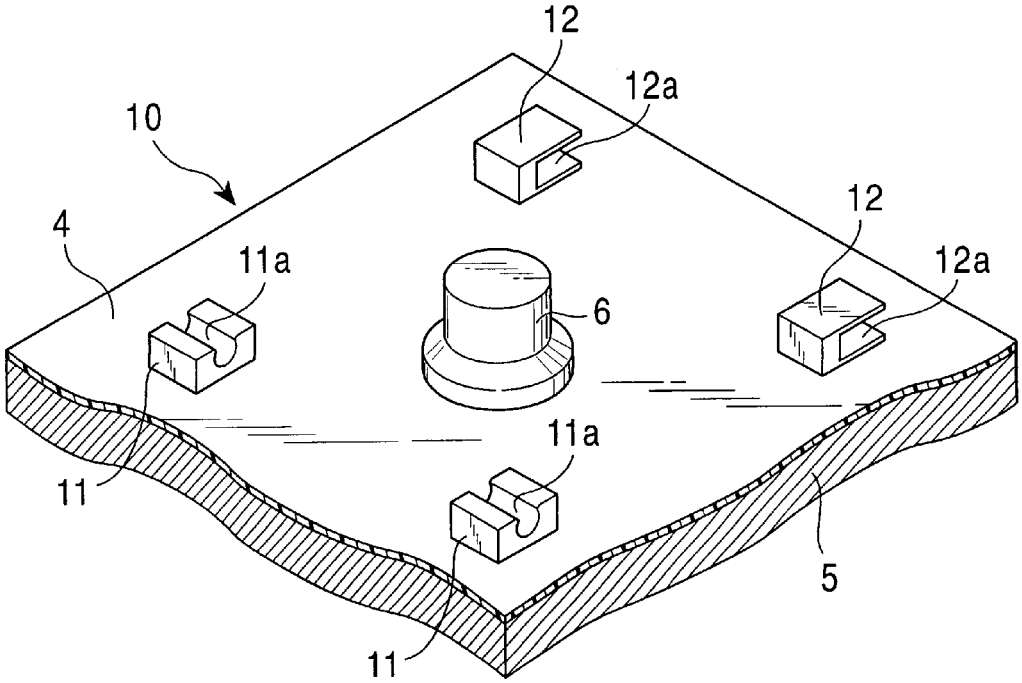
FIG. 3 is a perspective view showing the shape and disposition of the retaining members.

As shown in FIG. 3, two retaining members 11 are formed at both ends of the proximal end of the supporting member 2. The retaining members 11 have sections shaped almost like "U" and are provided with fitting grooves 11*a* formed laterally in the top surfaces thereof. Two retaining members 12 are formed at both ends of the proximal end of the supporting member 3. The retaining members 12 have sections shaped almost like "C", and slide grooves 12*a* thereof open in the opposite direction from the retaining members 11.

Figure 2:
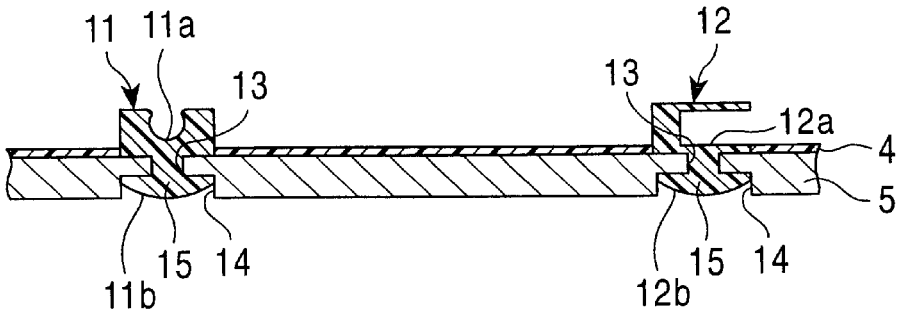
FIG. 2 is a sectional view showing retaining members that have been attached to a metal plate.

As shown in the sectional view of FIG. 2, through holes 13 and 13 are provided in the metal plate 5 at the locations where the retaining members 11 and 12 are to be formed (there is another pair of these components although not shown). Protuberances 15 and 15 provided at the bottom ends of the retaining members 11 and 12 are inserted in the through holes 13 and 13. Stopper portions 11*b* and 12*b* that have larger diameters than those of the through holes 13 and 13 are formed on the back surface of the metal plate 5 so as to tightly fasten the retaining members 11 and 12.

The retaining members 11 and 12 are fabricated using a molding method referred to as the outsert molding method wherein the through holes 13 and 13 are formed beforehand at the locations where the retaining members 11 and 12 are to be formed in the metal plate 5, then the metal plate 5 is clamped from both sides of the through holes 13 and 13 by a metal mold that has the retaining members 11 and 12 molded therein. A resin is poured into the mold, then the metal mold is removed. Thus, the retaining members 11 and 12 shaped like the ones shown in FIG. 1 through FIG. 3 are formed.

Recesses 14 and 14 having a diameter equal to or slightly larger than the diameter of the through holes 13 and 13 are formed in the back surface of the metal plate 5 having the through holes 13 and 13. These recesses 14 and 14 are press-formed by applying pressure to the metal plate 5 before or after forming the through holes 13 and 13 or at the same time when the through holes 13 and 13 are formed.

Preferably, the depth of the recesses 14 and 14 are set so that the vertexes of the stopper portions 11*b* and 12*b* are flush with or slightly recessed from the back surface of the metal plate 5 when the retaining members 11 and 12 are formed. The stopper portions 11*b* and 12*b* may be shaped to have, for example, flat heads, depending on the metal mold to be used.

The fitting groove 11*a* has a shape matching a columnar protuberance 2*b* (there is another pair of these components although not shown) formed on the proximal end of the supporting member 2. The fitting groove 11*a* is formed so that it is smaller than the diameter of the protuberance 2*b;* hence, once the protuberance 2*b* is fitted in the fitting groove 11*a,* it is rotatably supported such that it does not slip off the fitting groove 11*a.*

The slide grooves 12*a* are to be sufficiently large to allow columnar protuberances 3*b* and 3*b* formed at the proximal end of the supporting member 3 to be slidably fitted in the slide grooves 12*a*. Preferably, the slide grooves 12*a* have an internal dimension or height that does not cause the supporting member 3 to have play.

The membrane switch 4 is placed on the metal plate 5 on which the retaining members 11 and 12 have been formed, and fixed using an adhesive agent or the like. As shown in the example of the conventional art, the membrane switch 4 is composed of three layers of sheets, each layer being made of a transparent film sheet. The inner surfaces of the top and bottom sheets are provided with printed round switch patterns at the locations where the key tops 1 are to be formed, and also provided with printed wiring patters of lines in communication with external circuits, the inner surfaces with the printed patterns being opposed to each other. A transparent sheet provided as a spacer between the top and bottom transparent sheets has round cutouts at the locations where the foregoing switch patterns are formed. Thus, unless the key tops 1 are depressed, the switch patterns on the two sheets do not come in contact.

Further, a sheet member (not shown) for discharging static electricity is formed on the top surface of the membrane switch 4. To be more specific, the membrane switch 4 is formed directly on the top surface of the metal plate 5, and static electricity is generated through the cutouts or the like provided in the membrane switch 4 in some cases. The sheet member is formed to release the static electricity.

The sheet is black to prevent reflection caused by light seen through the gaps among the key tops 1 when viewed from above the key tops 1 and also to render the wiring patterns seen through the gaps invisible. The sheet is also adapted to provide higher adhesion strength than that obtained by bonding the elastic member 6 directly to the membrane switch 4.

The supporting members 2, 2, 3, and 3 are disposed at the four retaining members 11, 11, 12, and 12 formed as described above. At this time, the protuberances 2*b* of the supporting members 2 are disposed on the side of the retaining members 11, while the protuberances 3*b* of the supporting members 3 are disposed on the side of the retaining members 12.

Figure 5:
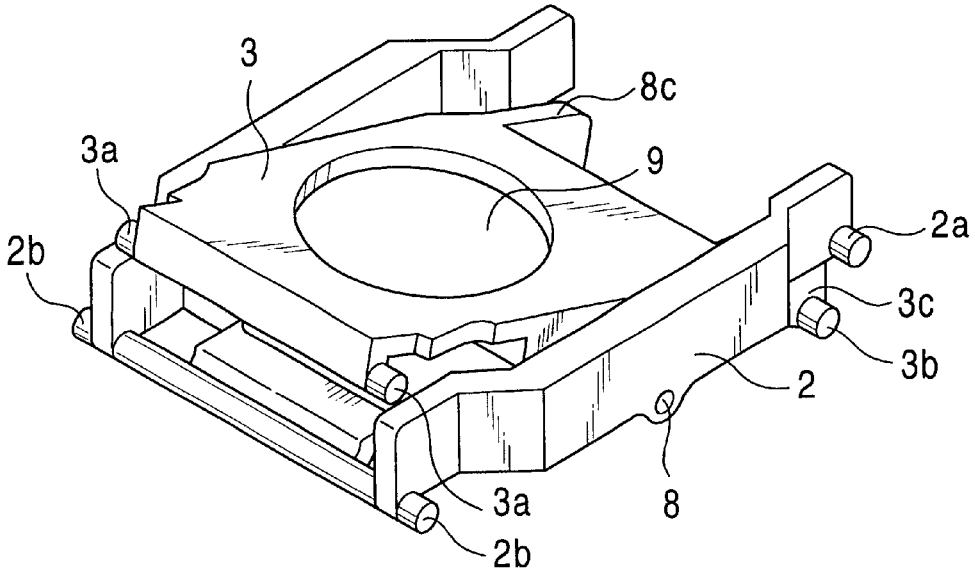
FIG. 5 is a perspective view showing the shape of a supporting member.
Figure 6:
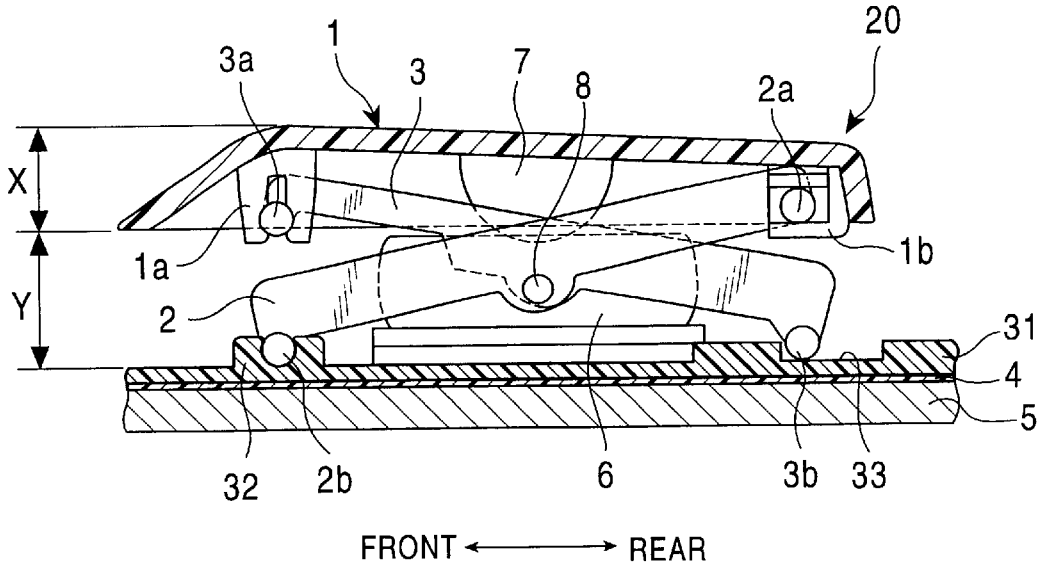
FIG. 6 PRIOR ART
FIG. 6 is a sectional view showing a side surface of a conventional keyboard apparatus.
Figure 7:
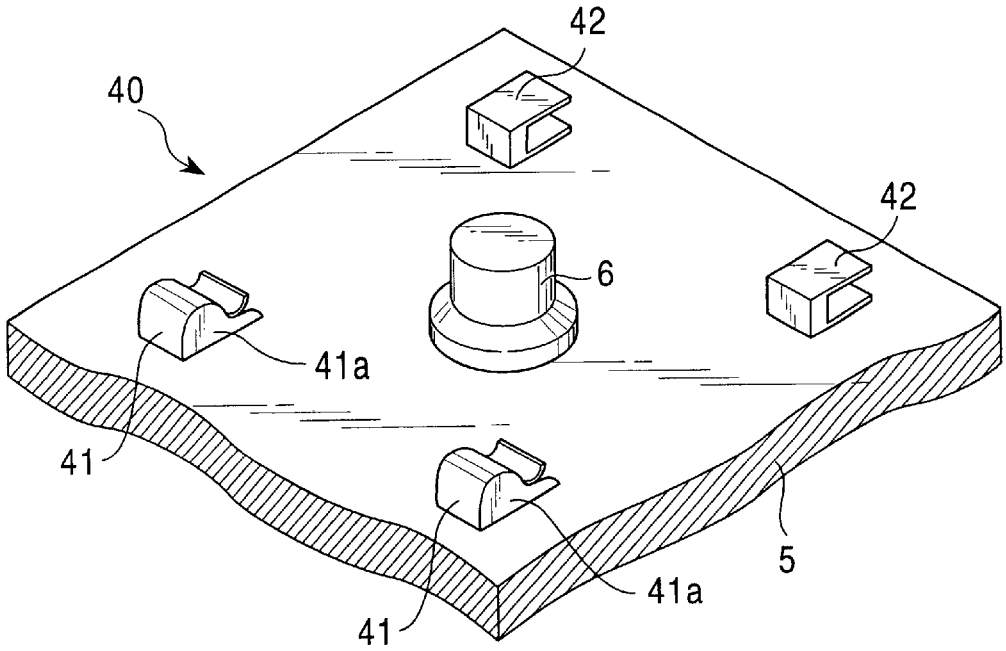
FIG. 7 PRIOR ART
FIG. 7 is a perspective view showing the structure of another conventional retaining members.

The supporting members 2 are shaped almost like "C" as shown in FIG. 5 and formed of a resinous constituent. The supporting member 3 is formed of a resinous constituent having a round inserting hole 9 formed at the center thereof. With the supporting members 2 located on the outer side, the supporting members 2 and 3 are rotatably attached by means of a shaft 8 projecting from the centers of the side faces of the supporting members 3 such that the two supporting members 2 and 3 intersect with each other and are joined at the intersecting points to have a pantograph configuration so that they may circularly move.

The distal ends of the supporting members 2 are provided with columnar protuberances 2*a* and 2*a* that protrude outward, and the distal ends of the supporting members 3 are provided with columnar protuberances 3*a* and 3*a* that protrude outward. The protuberances 2*a,* 2*a,* 3*a,* and 3*a* are respectively supported by retaining portions 1*a,* 1*a,* 1*b,* and 1*b* formed on the back surface of the key top 1.

The back surface of the key top 1 has a recess shaped like a boat. Formed at four corners of the recess are the retaining portions 1*a* and the retaining portions 1*b* that formed in a protruding manner. The retaining portions 1*a,* which are shaped so that they allow the protuberances 3*a* to circularly move therein, are formed on the side of the supporting members 3. The retaining portions 1*b,* which are L-shaped to allow the protuberances 2*a* to slide therein, are formed on the side of the supporting members 2.

The retaining members 12 and the retaining portions 1*b* mentioned above are to have a slide length that is long enough to prevent the supporting members 3 from coming off when the key tops 1 are positioned at their lowest position.

A projection 7 provided at the center of the back surface of the key top 1 pushes the elastic member 6 when the key top 1 is depressed.

The elastic member 6 is formed of a nearly conical rubber constituent, and fixed using an adhesive agent or the like to the black sheet member for discharging static electricity. In this case, the elastic member 6 is usually passed through the round inserting hole 9 of the supporting member 3 and abutted against the projection 7 provided on the back surface of the key top 1. Pressing the key top 1 downward by a finger causes the head of the elastic member 6 to go down against the urging force. Releasing the key top 1 causes the elastic member 6 to restore its original condition, so that the key top 1 restores its initial state. When the key top 1 is pressed by a finger to depress the head of the elastic member 6, the projection 7 presses the membrane switch 4 to turn it ON.

Installing the keyboard apparatus configured as discussed above in accordance with the present invention to a notebook-size computer enables the computer to be made thinner, thus contributing to a reduced weight and improved portability of the computer.

Figure 4:
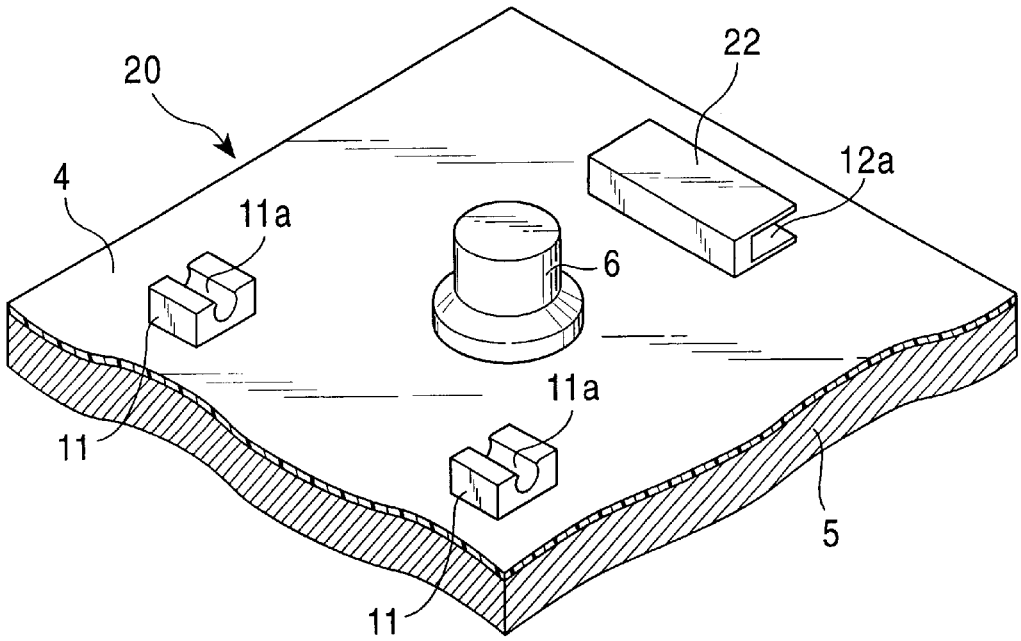
FIG. 4 is a perspective view showing the shape and disposition of other retaining members.

The keyboard apparatus in accordance with the present invention is not limited to the embodiment discussed above. As an alternative shown in FIG. 4, only one retaining member may be formed on the side of the supporting member 3, and one shaft is provided between the legs on both ends of the supporting member 3, so that the shaft and the foregoing retaining member are combine to form three-point support. Further alternatively, two-point support may be employed by using the support member 2 as one point. The number and the shape of the supporting members may be changed.

To form the retaining members 11 and 12 on the metal plate 5, other method than the outsert molding method may be used. For example, retaining members in which only the protuberances 15 and 15 have been formed in advance by using a metal mold with no stopper portions 11*b* and 12*b* shown in FIG. 2 are fabricated beforehand. Then, the retaining members are inserted in the metal plate with the through holes 13 formed at predetermined positions, and the protuberances 15 and 15 jutting out to the back surface of the metal plate 5 are melted to fasten the retaining members. At this time, in order to prevent play of the retaining members, they may be integrally formed at the time of molding so that they are joined together.

Further, in order to prevent the retaining members 11 and 12 from turning, the through holes 13 formed, in the metal plate 5 may have an angular shape rather than a round shape. Alternatively, the recesses 14 may be formed squarely and the stopper portions 11*b* and 12*b* may be accordingly formed squarely.

Thus, the keyboard apparatus in accordance with the present invention is able to be made thinner without sacrificing ease of operation or feel, by forming the resinous retaining members directly on the metal plate, and it also permits easier installation of the supporting members and shortens the time required for the installation. This leads to improved workability in the manufacturing process of the keyboard apparatus.

Installing the aforesaid thinner keyboard apparatus to a notebook-size computer makes it possible to achieve a thinner and lighter-weight notebook-size computer at lower cost.

What is claimed is:

1. A keyboard apparatus comprising:

a key top;

a plurality of supporting members which support the underside of the key top so that the key top may move up and down;

a plurality of receiving members, each receiving member engaging a proximal end of one of the plurality of supporting members, said receiving members comprising at least one first retaining member and at least one second retaining member, said first retaining member comprising an upwardly projecting U-shaped fitting groove configured to pivotally engage a columnar protuberance formed on the proximal end of the supporting member, said second retaining member comprising a laterally projecting C-shaped slide groove configured to slidably engage the columnar protuberance formed on the proximal end of the supporting member;

an elastic member which urges the key top upward at all times; and a membrane switch provided on the underside of the supporting member;

wherein the receiving members are directly fixed to a base supporting the membrane switch, said receiving members being configured so that a lower-most portion of the fitting groove and a lower-most portion of the slide groove are positioned not above an upper surface of the membrane switch.

2. A keyboard apparatus according to claim 1, wherein the base is formed of a metal plate, and each of the receiving members is formed through an opening in the metal plate by using a resin that is molded by an outsert molding process.

3. A keyboard apparatus according to claim 2, wherein each of the receiving members includes a stopper portion formed on a back surface of the metal plate, said stopper portion being positioned in a recess formed in the back surface of the metal plate so that it does not protrude outwardly from the back surface of the metal plate.

4. A keyboard apparatus according to claim 1, wherein:

the plurality of supporting members comprises a first supporting member and a second supporting member, and wherein the first supporting member is rotatably fitted in the fitting groove of the first retaining member, while the second supporting member is slidably inserted in the sliding groove of the second retaining member; and first and second supporting members intersect with each other and are joined with a shaft at an intersection point thereof so that they may circularly move.

5. A keyboard apparatus according to claim 4, wherein the first supporting member is snap fitted into the first retaining member by pressing the columnar protuberance of the proximal end of the first supporting member into the fitting groove of the of the first retaining member.

6. A keyboard apparatus according to claim 1, wherein each of the receiving members includes a stopper portion formed on a back surface of the base, said stopper portion being positioned in a recess formed in the back surface of the base to which the receiving member has been fixed, said stopper portion being positioned in the recess so that it does not protrude from the back surface of the base.

7. A keyboard apparatus according to claim 1, wherein each of the plurality of receiving members comprise an engagement portion, a neck portion and a stopper portion, said engagement portion being formed against a front surface of said base, said stopper portion being formed on a back surface of the base, and said neck portion extending through a hole in the base and connecting said engagement portion to said stopper portion.

8. A keyboard apparatus according to claim 7, wherein the U-shaped fitting groove is formed in the engagement portion of the first retaining member, and the C-shaped sliding groove is formed in the engagement portion of the second retaining member.

* * * * *

UNITED STATES PATENT AND TRADEMARK OFFICE

CERTIFICATE OF CORRECTION

PATENT NO. : 6,225,586 B1
DATED : May 1, 2001
INVENTOR(S) : Kazutoshi Watanabe et al.

It is certified that error appears in the above-identified patent and that said Letters Patent is hereby corrected as shown below:

Claim 5,
Line 5, delete "of the", second occurrence.

Signed and Sealed this

Sixteenth Day of April, 2002

*Attest:*

*Attesting Officer*

JAMES E. ROGAN
*Director of the United States Patent and Trademark Office*